US006508456B2

(12) United States Patent
Hulburd et al.

(10) Patent No.: US 6,508,456 B2
(45) Date of Patent: Jan. 21, 2003

(54) HEAVY DUTY CABLE PULLER

(75) Inventors: Richard Hulburd, Lake View Terrace, CA (US); Aristipo Sanchez, Burbank, CA (US)

(73) Assignee: Maasdam Pow'r Pull Incorporated, Burbank, CA (US)

( * ) Notice: Subject to any disclaimer, the term of this patent is extended or adjusted under 35 U.S.C. 154(b) by 24 days.

(21) Appl. No.: 09/804,199

(22) Filed: Mar. 13, 2001

(65) Prior Publication Data

US 2002/0130309 A1 Sep. 19, 2002

(51) Int. Cl.[7] ..... B21F 9/00; B66F 3/00; B25B 25/00

(52) U.S. Cl. ..... 254/218; 254/243

(58) Field of Search ..... 254/199, 217, 254/218, 222, 223, 237, 243

(56) References Cited

U.S. PATENT DOCUMENTS

| | | | | | |
|---|---|---|---|---|---|
| 109,466 | A | * | 11/1870 | Smith | 254/218 |
| 160,808 | A | | 3/1875 | Barnes | |
| 382,096 | A | * | 5/1888 | Lafo | 254/218 |
| 443,640 | A | * | 12/1890 | Burdick | 254/218 |
| 726,764 | A | | 4/1903 | Roper | |
| 940,884 | A | * | 11/1909 | Marty | 254/222 |
| 1,425,850 | A | * | 8/1922 | Gerrard et al. | 140/93 R |
| 1,832,760 | A | | 11/1931 | Bertuletti | |
| 2,506,029 | A | * | 5/1950 | Maasdam | 254/218 |
| 2,658,723 | A | | 11/1953 | Coffing | |
| 3,141,345 | A | | 7/1964 | Hartmann et al. | |
| 3,468,176 | A | | 9/1969 | Boucherie | |
| 4,199,134 | A | | 4/1980 | Kerber et al. | |
| 4,235,420 | A | * | 11/1980 | Ross et al. | 242/587.1 |
| 4,480,510 | A | | 11/1984 | Aparicio, Jr. et al. | |
| 4,723,757 | A | | 2/1988 | Steinman et al. | |
| 4,742,992 | A | * | 5/1988 | Allen | 254/199 |
| 5,186,586 | A | * | 2/1993 | Stephenson, Jr. | 24/265 CD |
| 5,271,606 | A | * | 12/1993 | Kamper | 254/217 |
| 6,076,805 | A | * | 6/2000 | Messersmith | 254/218 |

* cited by examiner

*Primary Examiner*—Emmanuel Marcelo
(74) *Attorney, Agent, or Firm*—Evan M. Kent; Stewart L. Gitler

(57) ABSTRACT

The cable puller uses a compound handle to create great leverage in order to generate a large pulling force with a minimal amount of force applied by the operator. The pulling force can be used for heavy lifting applications. The cable puller could be used to hoist motors, shafts, gears, automobile engines, construction material, machinery and other heavy objects. The cable puller could also be used in the demolition of building structures, the erection of buildings and towers, straightening collision damage, opening railroad car doors, securing tent structures, stretching fence and wire, and tightening conveyor belts. In one embodiment, the handle creates a lever ratio of 65:1. In this instance, 8,000 lbs. can be lifted with an exertion of 123 lbs. of force by the operator. The compound handle is formed by a driven member that engages and rotates the ratchet wheel. A cable is taken up by the wheel in order to move objects. The driven member is connected to a driving member by a connection member. The driving member has a handle grasped by the user and pivoted in order to cause the driving motion of the ratchet wheel.

3 Claims, 4 Drawing Sheets

HEAVY DUTY CABLE PULLER

FIELD OF THE INVENTION

The invention relates to cable pullers.

BACKGROUND OF THE INVENTION

Cable pullers are used to wind a cable about a drum. The cable end can be attached to an item in order to lift the item or the puller can be used to stretch the cable. It is known in the art to have cable pullers that are powered or operated by hand. To gain leverage in order to lift or pull heavy objects, on the order of three to four tons, existing cable pullers have a straight line telescoping handle. This arrangement creates several problems including: the operator having a difficult time guiding the load due to the distance of the handle from the drum; the impracticality of operating the device in a confined space; and the inherent safety risk of the lever inadvertently striking the operator.

U.S. Pat. No. 4,199,134 (Kerber et al) discloses a portable winch having a ratchet wheel and an actuator. The actuator carries a pawl and a grip. The actuator member is connected at the center of the ratchet wheel so that rotation of the actuation member causes the pawl to engage the ratchet wheel.

U.S. Pat. No. 4,723,757 (Steinman et al) discloses a portable winch having a ratchet wheel and an actuation member 16 provided with a grip. This actuation member is attached at the center of the ratchet wheel.

U.S. Pat. No. 2,658,723 (Coffing) discloses a hoist having a ratchet wheel and an actuation member carrying a pawl. A linkage connected to the center wheel spaces the actuation member from the wheel.

U.S. Pat. No. 1,823,760 (Pierce) discloses a jack having a ratchet wheel and an actuation member having a pawl. A handle connects to the end of the actuation member.

There is a need in the art for a cable puller having a handle providing leverage to create a large pulling force with a minimal amount of force applied by the operator.

It is another object of the invention to provide a cable puller having a compound handle that increases leverage and magnifies the force applied by the operator.

It is another object of the invention to provide a portable, compact cable puller that can be easily transported and used to generate a large pulling force.

It is another object of the invention to provide a reliable cable puller that is both easy to use and inexpensive to manufacture.

These and other objects of the invention will be become apparent to one of ordinary skill in the art after reviewing the disclosure of the invention.

SUMMARY OF THE INVENTION

The cable puller, embodying the present invention, uses a compound handle to create great leverage in order to generate a large pulling force with a minimal amount of force applied by the operator. The pulling force can be used for such applications as lifting heavy objects. The cable puller could be used to hoist motors, shafts, gears, automobile engines, construction material, machinery and other heavy objects. The cable puller could also be used in the demolition of building structures, the erection of buildings and towers, straightening collision damage, opening railroad car doors, securing tent structures, stretching fence and wire, and tightening conveyor belts. In one embodiment, the handle creates a lever ratio of 65:1. In this instance, four tons can be lifted with an exertion of 123 lbs. of force by the operator.

The compound action of the handle is similar to the low gear on a bicycle in that it reduces the operator's effort but causes the load to ascend and descend at a slower rate. The slower movement of the load reduces the risk to the operator as it is easier to control.

The compound handle is formed by a driven member that engages and rotates the ratchet wheel. A cable is taken up by the wheel in order to move objects. The driven member is connected to a driving member by a connection member. The driving member has a handle grasped by the user and pivoted in order to cause the driving motion of the ratchet wheel.

DETAILED DESCRIPTION OF THE INVENTION

Figure 1:
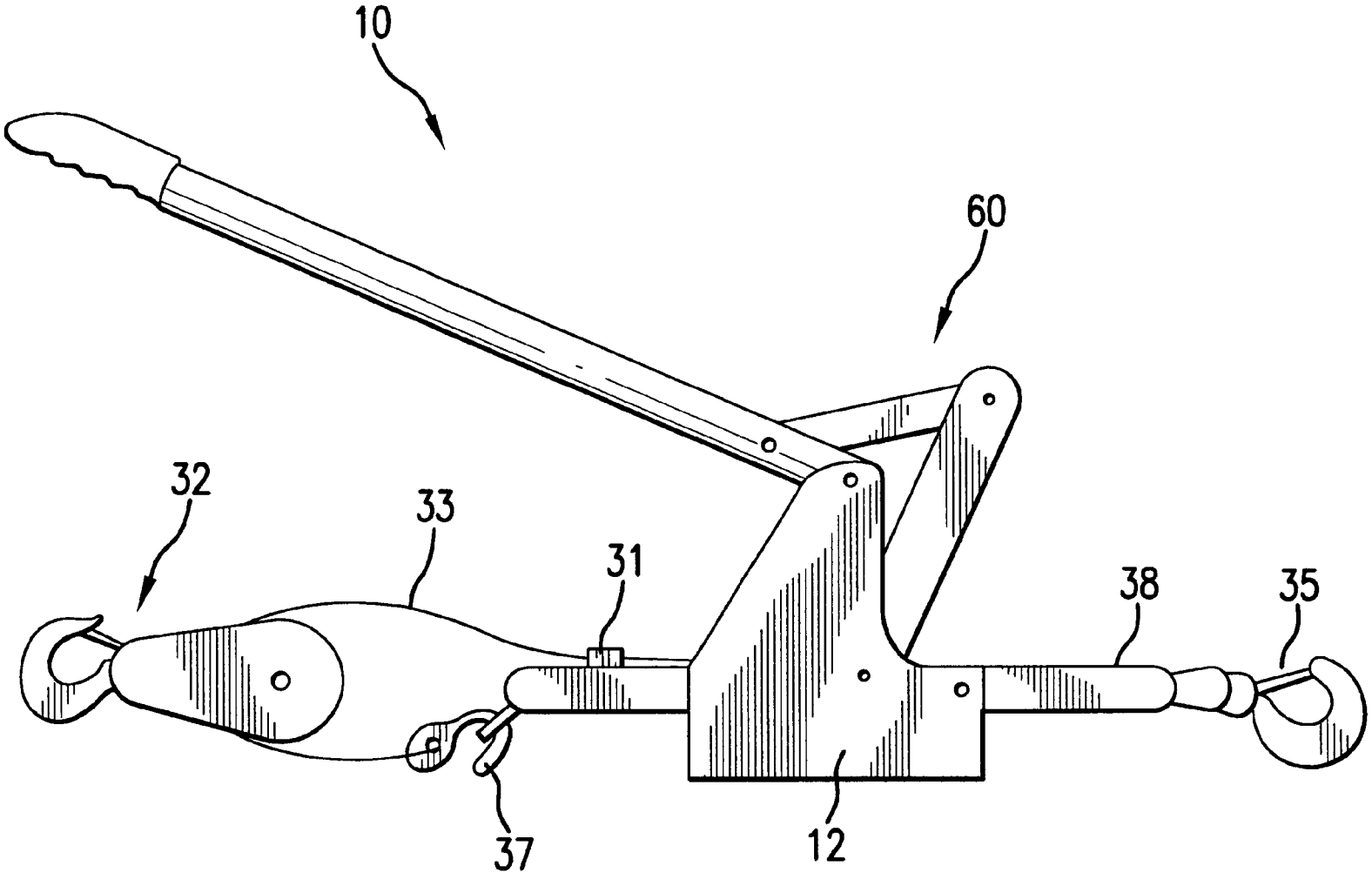
FIG. 1 is a plan view of the cable puller.

The cable puller 10 is depicted in FIG. 1. The frame 12 serves as the connection point for the parts that enable the cable puller to function. Connected to and extending from both sides of the frame 12 is a bottom member 38. Attached to one side of the bottom member 38 is a hook 35. A cable 33 is attached to the ratchet wheel, not shown, and extends through a cable guide 31 attached to the bottom member 38 and around a second hook/pulley assembly 32. The cable terminates in a third hook 37 which is releaseably attached to the bottom member 38.

Rotation of the ratchet wheel is accomplished by manipulation of a handle 60. With rotation of the ratchet wheel, the cable 33 is wrapped about the ratchet wheel and decreases the distance between the first hook 35 and second hook 32. With the shortening of the effective length of the cable, force is applied to the objects attached to the first hook 35 and second hook 32.

Figure 2:
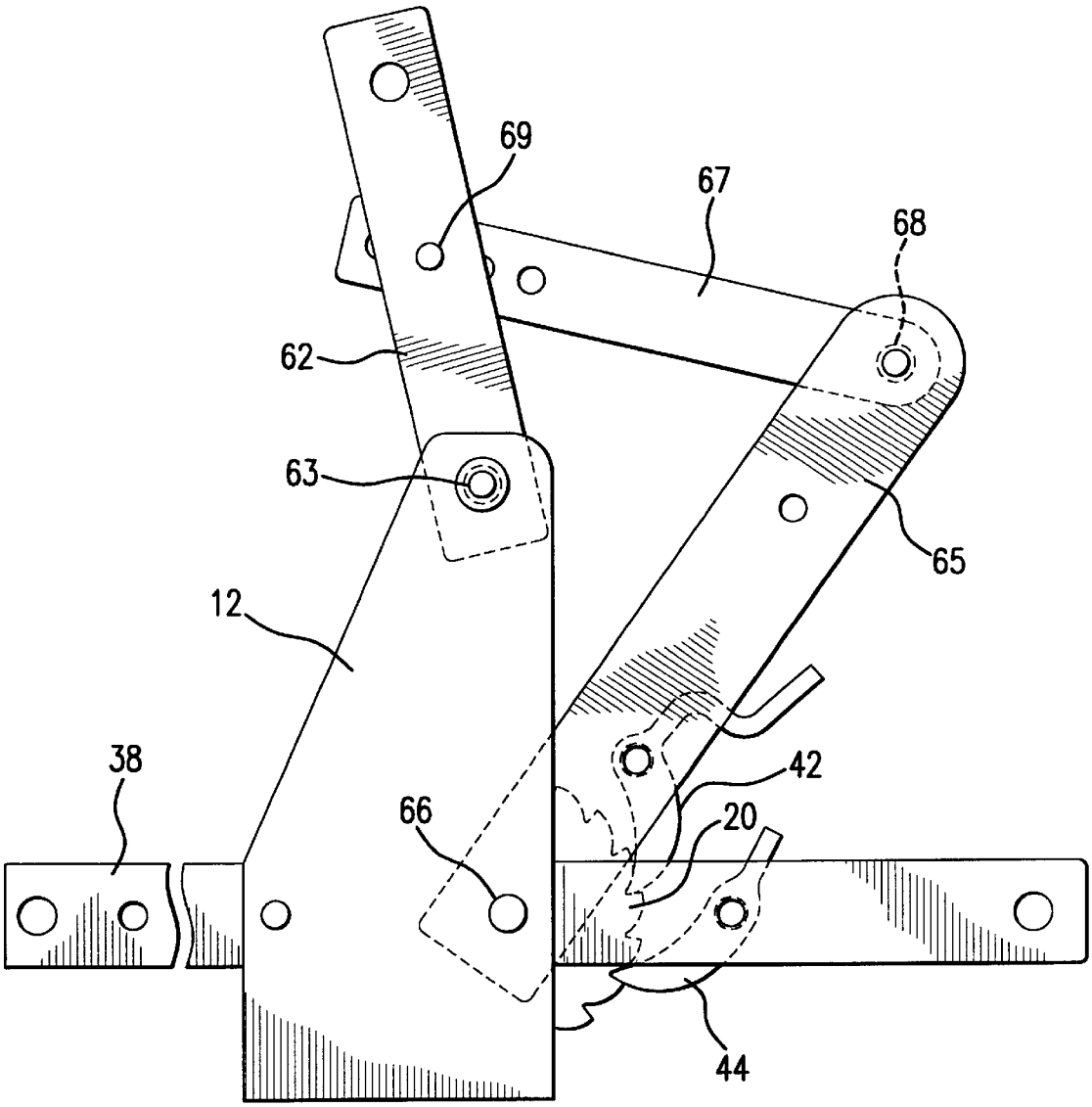
FIG. 2 is a plan view of the cable puller with the cables and hooks removed.

The cable puller having the cables and hooks removed can be seen in FIG. 2. As is depicted in FIG. 2, the frame 12 serves as an attachment point for the various parts that effectuate the operation of the device. The bottom member 38 is connected to and extends from both sides of the frame 12. The bottom member serves as an attachment point for the hooks that will be used in the pulling operation. The cable is wrapped around a ratchet wheel 20, shown in partial phantom. When rotated, cable is wrapped about the ratchet wheel 20 to shorten the available length of cable. In the reverse operation of lowering an object, the drum rotates in a reverse direction and cable is let out.

The structure of the compound handle 60 can clearly be seen in this figure. The driving member 62 connects to a top point of the frame 12 at a pivot point 63. The driving member is grasped and rotated about the pivot point 63. A connecting member 67 is rotatably connected at junction 69 to the driving member to allow for relative rotation between the driving member 62 and the connecting member 67. The opposite end of the connecting member 67 is rotatably connected at a junction 68 to a driven member 65. Junction 68 allows relative rotation between the driven member 65 and connecting member 67. The connecting member transfers the rotational motion of the driving member 62 to the driven member 65.

The driven member 65 is pivotally connected to the frame at pivot point 66. This pivot point 66 is coaxial with the center of the ratchet wheel 20. A ratchet pawl 42 is attached to the driven member 65 at a point spaced from the pivot point 66 so that the end of the ratchet pawl 42 engages the teeth of the ratchet wheel 20. When the driven member rotates about pivot point 66, the ratchet pawl engages and drives the ratchet wheel 20. A stop pawl 44 is connected to the bottom member 38. Its function is to prevent counter rotation of the ratchet wheel 20.

Figure 3:
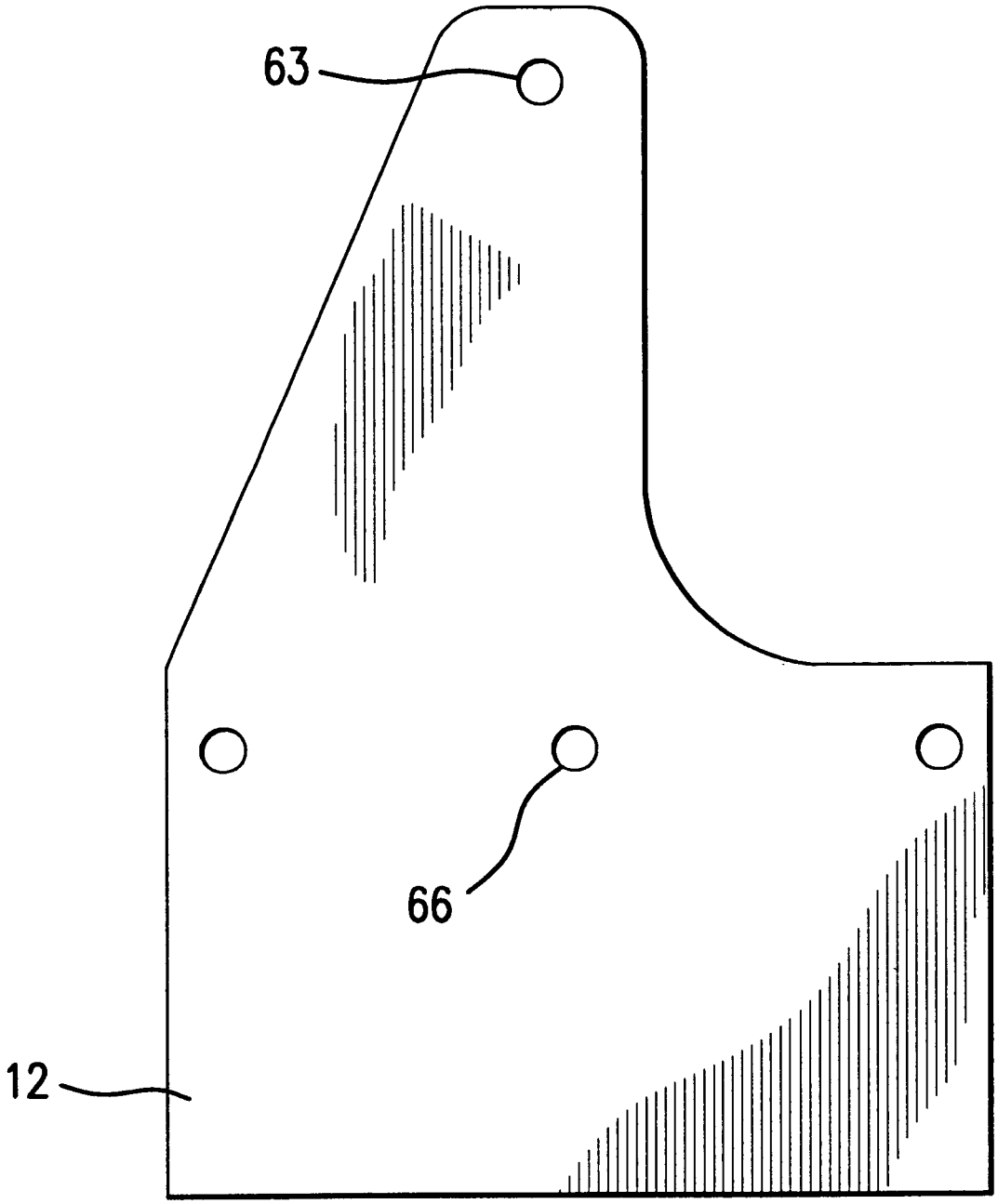
FIG. 3 is a plan view of the frame of the cable puller.

FIG. 3 shows the frame without the attachment of any of the other pieces of the device. As illustrated, the housing has several apertures for the attachment of pieces of the device. Some attachment points allow pivotal rotation, as previously discussed.

Figure 4B:
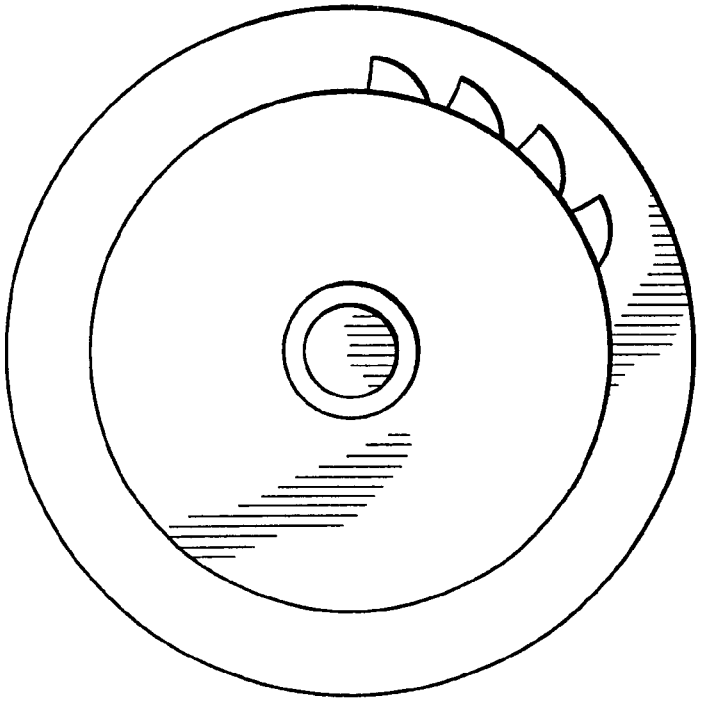
FIG. 4*b* is a view from line b—b of FIG. 4*a*.
Figure 4A:
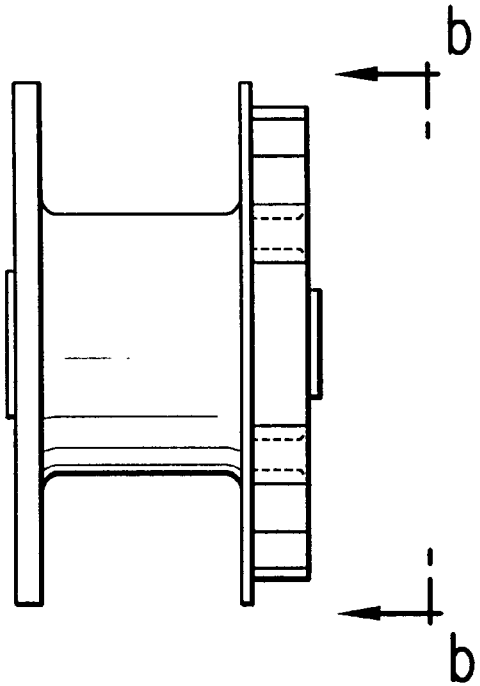
FIG. 4*a* is a side view of the ratchet wheel.

FIG. 4*a* and FIG. 4*b* show the side and end view of the ratchet wheel respectively. The ratchet wheel is a conventional design having a drum for holding the cable. Ratchet teeth are provided on one side of the ratchet wheel. In FIG. 4*b*, only a few teeth are depicted, for clarity. The teeth are engaged by the ratchet pawl to rotate the drum. The ratchet drum does not differ in structure from ratchet wheels used in the existing art.

The device allows the exertion of a large amount of force on an object with minimal force applied by an operator. The compound handle design allows for a great amount of leverage, while in a compact size allowing for easier, safer use.

While the invention has been described with respect to preferred embodiment, variations, modifications would be apparent to one of ordinary skill in the art without departing from the spirit of the invention.

What is claimed is:

1. A cable puller, comprising:

a frame, a ratchet wheel connected to said frame, a handle for rotating said ratchet wheel, said handle comprising:

a driven member, said driven member pivotally connected to said frame;

a ratchet pawl attached to said driven member and engaging said ratchet wheel;

a driving member pivotally attached to said frame;

a connecting member pivotally connected to said driving member and said driven member; and wherein said connecting member is connected to a midpoint of said driving member and an end of said driven member.

2. The cable puller of claim 1, further comprising:

a bottom member, and a stop pawl attached to said bottom member for preventing counter rotation of said ratchet wheel.

3. The cable puller of claim 1, wherein said cable puller has a lever ratio of 65:1.

* * * * *